US008387548B2

(12) United States Patent
Ohnstad et al.

(10) Patent No.: US 8,387,548 B2
(45) Date of Patent: Mar. 5, 2013

(54) MARINE-VESSEL, ANTI-PUNCTURE, SELF-SEALING, WATER-LEAK PROTECTION

(75) Inventors: Thomas S. Ohnstad, Salem, OR (US); Russell A. Monk, Salem, OR (US)

(73) Assignee: High Impact Technology, Inc., Tigard, OR (US)

( * ) Notice: Subject to any disclaimer, the term of this patent is extended or adjusted under 35 U.S.C. 154(b) by 612 days.

(21) Appl. No.: 12/381,433

(22) Filed: Mar. 11, 2009

(65) Prior Publication Data

US 2009/0239064 A1 Sep. 24, 2009

Related U.S. Application Data

(60) Provisional application No. 61/069,210, filed on Mar. 12, 2008.

(51) Int. Cl.
*B63B 43/10* (2006.01)

(52) U.S. Cl. ..... 114/69; 114/227; 220/560.02; 428/339

(58) Field of Classification Search ..... 114/69, 114/68, 227, 228, 229; 220/560.01, 560.02
See application file for complete search history.

(56) References Cited

U.S. PATENT DOCUMENTS 534,611 A * 2/1895 Marsden ..... 114/69
617,902 A * 1/1899 Maurice et al. ..... 114/69
2,278,938 A * 4/1942 McQuerry ..... 114/9
2,403,836 A 7/1946 Wagner
2,605,138 A 7/1952 Paasche
2,802,763 A * 8/1957 Freedlander ..... 220/560.02
3,509,016 A 4/1970 Underwood et al.
3,606,154 A 9/1971 Tufts
3,664,904 A 5/1972 Cook
3,676,197 A 7/1972 Harrison et al.
3,698,587 A 10/1972 Baker et al.
3,801,425 A 4/1974 Cook
4,083,318 A * 4/1978 Verolme ..... 114/74 A
4,115,616 A 9/1978 Heitz et al.
4,197,092 A 4/1980 Bretz
4,216,803 A 8/1980 Hall
4,345,698 A 8/1982 Villemain
4,352,851 A 10/1982 Heitz et al.
4,422,561 A 12/1983 Grosvenor et al.
4,467,015 A * 8/1984 Clem ..... 428/454
4,529,626 A 7/1985 Baker et al.
4,615,936 A * 10/1986 Baum ..... 442/413
4,728,711 A 3/1988 Rosthauser et al.
4,783,340 A 11/1988 McDonnell et al.
4,799,454 A 1/1989 Ito
4,808,042 A 2/1989 Muehlberger et al.
5,079,088 A * 1/1992 McGroarty et al. ..... 428/331
5,306,867 A 4/1994 Connole et al.
(Continued)

OTHER PUBLICATIONS

Dictionary.com entry for Bead, available at http://dictionary.reference.com/brouse/bead?s=t (retrieved Jun. 19, 2012).*

*Primary Examiner* — Jennifer McNeil
*Assistant Examiner* — Scott R Walshon
(74) *Attorney, Agent, or Firm* — Jon M. Dickinson, Esq.; Robert D. Varitz, Esq.

(57) ABSTRACT

An anti-puncture, water-leak-inhibiting, self-sealing, coating structure for application selectively to inside and/or outside portions of a boat hull. The coating structure, in operative condition with respect to such a hull portion, includes a body of continuous-phase, non-water-reactive, high-elastomeric-material, and, embedded within that body, in an initially shrouded and non-exposed condition guarded nominally against any contact with external water, a distribution of water-reactive, water-imbiber beads.

2 Claims, 1 Drawing Sheet

U.S. PATENT DOCUMENTS 5,463,791 A 11/1995 Roden
5,472,743 A 12/1995 Daluise
5,547,722 A * 8/1996 Uehara et al. ..... 428/35.7
5,691,410 A 11/1997 Escarsega et al.
5,853,215 A 12/1998 Lowery et al.
6,040,356 A 3/2000 Kanki et al.
6,103,641 A 8/2000 Gehring, Jr.
6,116,181 A * 9/2000 Kalamaras ..... 114/357
6,358,580 B1 3/2002 Mang et al.
6,432,882 B1 8/2002 Yamamoto
6,803,400 B1 10/2004 Butterbach et al.
7,169,452 B1 1/2007 Monk et al.
7,220,455 B2 5/2007 Bennett et al.
7,229,673 B1 6/2007 Monk et al.
7,381,287 B2 6/2008 Monk et al.
7,393,572 B1 7/2008 Monk et al.
7,678,453 B2 3/2010 Monk et al.
7,732,028 B2 6/2010 Monk et al.
7,785,670 B2 8/2010 Ohnstad et al.
7,854,968 B2 12/2010 Ohnstad et al.
7,901,750 B2 3/2011 Atwood et al.
8,043,676 B2 10/2011 Ohnstad et al.
2004/0065456 A1 4/2004 Belli et al.
2004/0231703 A1 11/2004 McCormick et al.
2005/0013992 A1* 1/2005 Azad et al. ..... 428/327
2005/0084334 A1 4/2005 Shi et al.
2005/0100667 A1 5/2005 Mayer et al.
2005/0202181 A1 9/2005 Grossmann et al.
2006/0121245 A1 6/2006 Lasson
2006/0257595 A1* 11/2006 Atwood et al. ..... 428/34.1
2006/0269680 A1 11/2006 Bennett et al.
2009/0004433 A1* 1/2009 Privitera et al. ..... 428/143

* cited by examiner

MARINE-VESSEL, ANTI-PUNCTURE, SELF-SEALING, WATER-LEAK PROTECTION

CROSS REFERENCE TO RELATED APPLICATION

This application claims priority to U.S. Provisional Patent Application Ser. No. 61/069,210, filed Mar. 12, 2008, for "Protection of a Marine Vessel Hull or Bulkhead Against Water Leakage". The entire disclosure content of that provisional application is hereby incorporated herein by reference.

BACKGROUND AND SUMMARY OF THE INVENTION

This invention pertains to an anti-puncture (as by a bullet wound), self-sealing, water-leak-inhibiting, coating, or coating structure, preferably sprayed into place on a boat hull (also referred to herein as the hull of a water vessel), and deployed, selectively, on either an outside surface area only, an inside surface area only, or on both outside and inside surface areas, of such a hull. In the present description of the invention, the term "hull" herein is intended to refer not only what is classically recognized to be that portion of a boat which directly engages a supporting body of water, but also any relevant, and user-selectable, internal bulkhead, such as a bilge bulkhead, or the like, which might be exposed to a water-leak-risk puncture wound.

The self-sealing coating of the present invention, which is also referred to herein generally as a water-leak-inhibiting, spray-applied protection structure for various, herein-named portions of a boat hull, specially employs seal-enhancing, water-reactive material, and offers a number of important, interesting and extremely useful advantages with respect to inhibiting water-leakage. One of these interesting advantages, as will be seen, is that the pressure of water itself, on the "leakage-in" side of a leak, plays a contributing role in sealing a puncture leak. So, in two important ways, the very water medium against which leakage protection is provided by the invention is centrally enrolled in the intended anti-leak behavior of the invention.

By way of generally related background information, reference is here made to U.S. Pat. No. 7,169,452 B1, in which patent, there is described and illustrated a self-healing coating applied to the outside of a liquid, petrochemical fuel container to seal an "inside-to-outside" fuel leak caused by a projectile puncture wound. In that patent, the illustrated and described coating is formed with plural layers, including a pair of bracketing, "outer" layers which are formed of a fuel-reactive, high-elastomeric material, and sandwiched-between these two outer layers, an intermediate layer formed with a body of essentially the same, just-mentioned, high-elastomeric material and further including an entrained population of fuel-reactive, solid-polymer, liquid-imbiber beads. The entirety (all layers included) of the high-elastomeric material which is employed in the coating structure of the invention forms what is referred to herein as a continuous-phase body of material.

With respect to this prior art patented structure, while it is generally related in a background sense to the present invention, it is important to note that all of the fuel-reactive materials which make up the illustrated coating, prior to any puncture leak occurring, are initially, and normally, completely out of contact with the liquid fuel regarding which they are intended to react to assist in sealing that leak. This condition, as it will be seen, describes one of several important differences that distinguish the technology content of this background patent from that of the present invention.

More particularly, in the present context of protecting a boat hull against a water leak produced by a similar kind of puncture wound, and recognizing that the coating structure of the invention employs, as mentioned above, a specially included, water-reactive sealing material, it is important to recognize that this coating structure, particularly when it is applied to and on the outside of a hull, though it can be true also with respect to coating material applied to and on the inside of a hull, such as within the bilge area of a hull, will be, either continuously, or frequently, directly in contact with water—the very liquid with respect to which a reaction will "ultimately" be produced, in accordance with operation of the present invention, to assist in a sealing action if and when a puncture wound occurs. Obviously, such a coating structure, though it must reside normally within a contacting water environment, must not be one in which the very material content therein which is intended to react to leaking water is subjected, initially and nominally, to direct exposure to water, with respect to which "unwanted exposure" the coating would most certainly "pre-spend" itself before any actual water-leakage occurs.

Accordingly, the coating (coating structure) proposed by the present invention includes a body of continuous-phase, non-water-reactive, high-elastomeric-material, and embedded within that body, in an initially shrouded and non-exposed condition guarded nominally against any contact with external water, a distribution of water-reactive, water-imbiber beads. In a more particular sense, the invention coating takes the form of a plural-layer construction which features (a) a pair of spaced layers, referred to as inner and outer layers, that are made solely of a suitable, non-water-reactive, high-elastomeric material, and (b) a special, intermediate layer which is formed with a body of similar high-elastomeric material containing the mentioned embedded, and initially and nominally "shrouded/guarded" (against initial, non-puncture water contact) population of liquid(water)-imbiber beads which are reactive specifically to water. These imbiber beads furnish the only material in the entire proposed coating structure which reacts (with a swelling/congealing response) to contact with water.

With respect to this coating, the employed high-elastomeric material plays an important response role, but not a material-reactive/water-reactive response role, when a puncture wound occurs. Material reaction to contact with water, which kind of reaction does definitively occur ultimately in the invention's rapid and effective response to a through-puncture wound, does not occur until after an actual, "through-puncture" water leak occurs, which leak exposes, to direct contact with water, the centrally embedded water-imbiber beads. These beads, on such contact, react with swelling and congealing actions, and through such actions respond rapidly, in cooperation with adjacent high-elastomeric-material, tension-based, compressive behavior, to seal a water-leak puncture wound.

While different high-elastomer materials may be employed in the coating structure of the present invention, one high-elastomeric product/system material, a preferred material, which has been found to be extremely effective is sold under the trademark LINE-X® protective coating, a polyurea, high-elastomer material made by Advanced Protective Coatings, dba LINE-X, a company based in Huntsville, Ala. Another very suitable high-elastomer material is a two-component, polyurethane product made by Rhino Linings, USA, a company based in San Diego, Calif., sold by that company under the trademark TUFF STUFF®. The mentioned water-imbiber beads preferably take the form of the solid-phase, polymer-bead product sold under the trademark AQUA BIBER®, made by Imbibitive Technologies America, Inc. in Midland, Mich.

Where one chooses to employ principally, rather than the LINE-X® product, the TUFF STUFF® product as the principal, high-elastomeric material in a coating made in accordance with the present invention, then, on the outside of a boat hull, it may be desirable to use also the somewhat higher-durometer, above-mentioned LINE-X® polyurea product either as an additional, exposed, outer layer applied to a TUFF STUFF® nominal water-exposed outer layer, or to use the mentioned LINE-X® product to form the entirety of a water-exposed outer layer. Such a higher-durometer outer layer, as an option, has the advantage of furnishing better abrasion resistance regarding accidental "hull contact" with some outside foreign structure.

All of the herein mentioned high-elastomeric products are compatible with, and bond well to, one another, and as a consequence form, in a finished coating structure, a continuous-phase, body of non-water-reactive, elastomeric material.

The proposed coating is preferably one which, (a) is, as mentioned above, spray applied to the locations where it is used, (b) is a multi-layer structure, (c) adds relatively little to the overall weight of a boat, and (d), with respect to where it is applied to water-contact areas on the outside of a boat hull, furnishes a very smooth-surfaced outside "finish" which does not inhibit efficient boat-hull travel through the water. Uniquely, the protection coating of the present invention: (1) is highly elastomeric in nature (a condition—referred to with the term "high-elastomeric" which we apply to the high elastomericity of the chosen, preferred and above-mentioned high-elastomeric materials—well over 200% reversible stretch capability—a condition which is important for reasons which will become apparent as further description of the invention follows below: and (2), enhanced by including an initially nonexposed, internally embedded (about 22% by volume) population of water-imbiber beads which react to puncture/penetration-event contact with water to function with an aggressive swelling and congealing action which responds very rapidly to such water exposure.

Interestingly, and as has been mentioned, the protective coating of this invention is, and this is certainly nearly always true on the outside of a boat hull, constantly exposed to the very substance—water—with respect to which it's embedded imbiber beads are intended to react with a swelling and sealing action. But, this coating must not react to water until there is a puncture event.

Another important and interesting feature of the invention, worth stressing again here, is that, with respect to coating structure applied to the outside of the hull, or applied anywhere that "outside", contacting water bears against that structure, on the occurrence of a puncture wound, and of resulting exposure of the embedded imbiber beads to water (with a resultant bead-swelling and sealing action), this sealing activity is greatly enhanced by the fact that the entire, adjacent and overlying coating structure is continually compressively influenced by the continuous "outer side" (water-side) pressure of water. In other words, and as was stated earlier, the very substance—water—whose leakage is to be prevented, is actually employed, through water-pressure compression of outer portions of the coating structure of the invention, to assist in sealing action.

These and other features and advantages that are offered by the present invention will become more fully apparent as the detailed description thereof which now follows is read in conjunction with the accompanying drawings.

DESCRIPTIONS OF THE DRAWINGS

FIG. 1 is a simplified, side elevation illustrating a boat, also referred to herein as a water vessel, floating in a body of water and including self-sealing, anti-water-leakage, protective coating structure made in accordance with a preferred and best-mode embodiment of the present invention. This coating structure, as specifically pictured herein, is applied in coating expanses to opposite, inner and outer sides, of the boat hull, as well as to opposite sides of an internal hull bulkhead which appears in dashed lines as an upright structure in FIG. 1.

Figure 1:
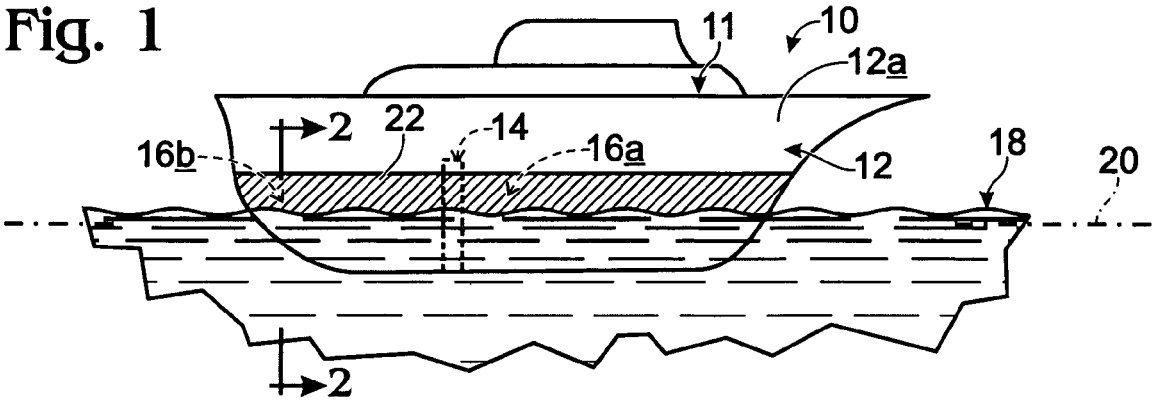

The various structures which are illustrated in the drawing figures are not drawn to scale.

DETAILED DESCRIPTION OF THE INVENTION

Turning now to the drawings, indicated generally at 10 in FIG. 1 is a boat, or water vessel, which is pictured with an orientation headed toward the right in this figure. Boat 10 includes a hull 11 having an outer, main-body hull portion 12, and at least one inner, internal, lower, bulkhead hull portion, such as the bulkhead shown in dashed lines at 14 in FIGS. 1 and 2. Bulkhead 14 is located in the bilge area of hull 11, and divides this area into a pair of longitudinally spaced compartments, such as those shown generally at 16*a*, 16*b* in FIG. 1.

Figure 2:
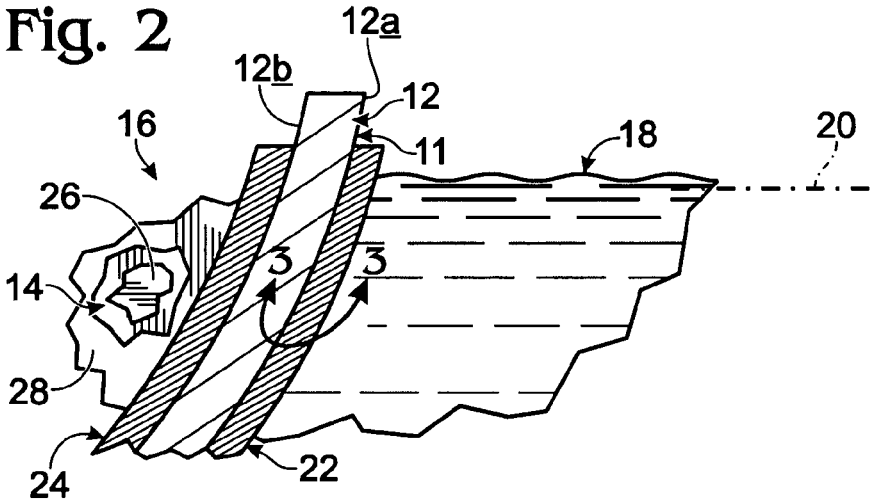
FIG. 2 is an enlarged, fragmentary drawing taken generally along the line 2-2 in FIG. 1.

Boat 10, in FIGS. 1 and 2, is shown floating in a body of water 18 which, together with hull 11, defines a nominal boat/water waterline 20.

Formed, preferably as by spraying, on the opposite, outer and inner sides 12-*a*, 12*b*, of hull portion 12 are self-sealing, anti-puncture, water-leak-inhibiting, coating-structure, or coating, expanses, 22, 24, respectively, prepared as three-layer (plural-layer) unified structures, or constructions, in accordance with a preferred and best-mode embodiment of the present invention. These two protective coating expanses face one another substantially coextensively on the opposite sides of hull portion 12, extending upwardly on this hull portion to a region slightly above previously mentioned waterline 20.

Opposite, fore-and-aft sides of bulkhead 14 are similarly prepared with like protective coating expanses 26, 28, respectively, as is best seen in FIG. 2 (and not seen in FIG. 1).

In the illustration of the invention now being described, coating expanses 22, 24, 26, 28 collectively constitute a preferred and best-mode embodiment of anti-puncture, water-leak-inhibiting, self-sealing coating structure, disposed in an operative condition with respect to boat 10 and hull 11 in accordance with the present invention.

From what has been described so far herein, it will be evident that, under all circumstances with boat 10 floating in water 18, substantially the entirety of coating expanse 22 will continuously be exposed on its outer side to water, which exposure will apply a well understood gradient of inwardly directed pressure against this expanse. Similarly, and to the extent that any water is contained in either one or both of compartments 16*a*, 16*b* in bilge 16, the associated one of coating expanses 26, 28 will likewise be subjected to applied water-pressure.

Continuing with details of the coating structure of the invention, in the particular embodiment of the invention which is now being described, all of the several, anti-leak, coating-structure expanses which have just been mentioned are substantially the same in construction. Accordingly, a description of these expanses will now be offered particularly, and singularly, in the context of coating expanse 22.

In general terms, each of these coating expanses, such as illustrative expanse 22, is designed to be "nominally", i.e., initially, non-reactive, in any sealing manner, to exposure to water, in the sense that, under non-puncture, non-penetration conditions, each of these expanses is to remain substantially unchanged, and from a water-reaction point of view, "quiet", in the presence of adjacent, contacting water. However, on a penetration occurring which might subject vessel 10 to difficulty or to danger, such as might result from a below-waterline penetration of hull 11, or some kind of penetration of bilge bulkhead 14, that act of penetration unveils an internal region in the associated protective coating expanse in a manner which specifically exposes, to direct water contact, certain internal coating structure (shortly to be more fully discussed) which is designed to react to such contact with a then initiated, rapid, and extremely effective, water-imbibing, self-sealing action.

As will be observed, the coating structure of the present invention will be in many instances, and certainly always in the case of coating expanse 22, substantially, fully exposed to the very liquid medium—water—with respect to which it is intended to react under puncture and penetration conditions to change in internal condition in a way that evokes a rapidly deployed, anti-leak sealing action.

Figure 3:
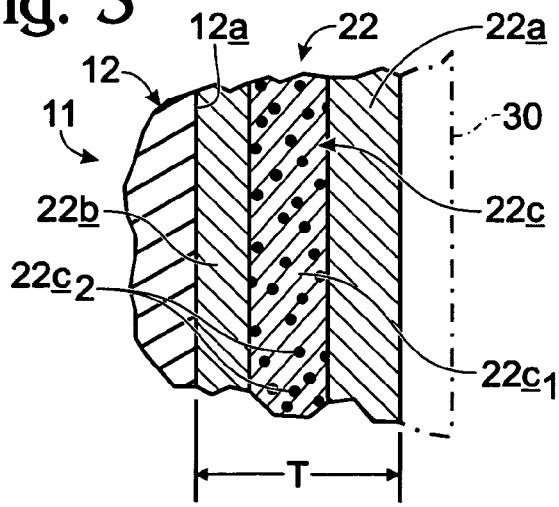
FIG. 3 is a still further enlarged, fragmentary view taken generally in the region embraced by double-arrow-headed, curved line 3-3 in FIG. 2. A dash-dot-line in FIG. 3 is included there for the purpose of illustrating one modified form of the invention.

Focusing attention now specifically on FIG. 3 in the drawings, coating expanse 22 has a plural-layer construction, including an outer layer 22*a*, a spaced inner layer 22*b*, and sandwiched integrally between these two, outer and inner layers, an intermediate layer 22*c*. Preferably, while each of these layers does not necessarily have the same thickness as does any other layer, each of these layers herein has a minimum thickness of about ⅛-inches. In the particular coating expanse (22) now being described, the three layers therein have a common thickness of slightly more than 1-8 inches, with these three layers thus producing an overall expanse thickness T which is somewhat more than ⅜-inches.

Each of layers 22*a*, 22*b*, 22*c* includes a high-elastomeric, non-water-reactive, layer body which is preferably formed of the previously mentioned LINE-X® material. Layers 22*a*, 22*b* are formed essentially solely of such elastomeric material. Layer 22*c*, however, which also includes such an elastomeric layer body, such being shown particularly in FIG. 3 at $\mathbf{22}c_1$, further includes, embedded in body $\mathbf{22}c_1$ in what is referred to herein as being a shrouded and non-exposed condition, a distribution of plural water-reactive, water-imbiber beads, such as the beads shown at $\mathbf{22}c_2$. These beads are made herein preferably of the product identified above which is sold under the trademark AQUA BIBER®. In the particular coating structure which is now being described, and as was mentioned earlier herein, beads $\mathbf{22}c_2$ occupy by volume about 22% percent of the overall intermediate layer.

The high-elastomeric material which is employed in coating expanse 22, in each of the mentioned, three layers, is of such a nature that spray-formation of each layer, in appropriate succession, causes all of this elastomeric material to form what has been referred to earlier as a continuous-phase body of non-water-reactive material. A consequence of this is that, while the structure of coating expanse 22 includes the three, mentioned layers, an actual cross section of the coating would not reveal any line of elastomeric-material demarcation between adjacent layers. Finally, with respect to coating expanse 22, the overall exposed edge of this expanse is appropriately spray formed with high-elastomeric material only, whereby the water-imbiber beads included within intermediate layer 22*c* are not initially exposed on this edge.

Completing a description now of what is shown in the drawings, and still referring particularly to FIG. 3, appearing on the right-hand side of this figure is a dash-dot outline 30 which represents a portion of one of several modified forms of the invention which we recognize may be made, and which is related to certain invention modifications mentioned earlier herein. More specifically, in this modified form of the invention, regarding which FIG. 3 should now be viewed as illustrating, and within modified coating expanse 22, per se, the elastomeric material employed in layers 22*a*, 22*b*, 22*c* takes the form of the above-referred-to TUFF STUFF® material. In this modified construction, coating expanse 22, as previously described in the preferred invention embodiment, may have essentially the same layer thickness sizing and arrangement described earlier, with, in accordance with the modification of the invention which is now being described, dash-dot outline 30 representing an additional, outside, high-elastomeric layer formed of the higher durometer LINE-X® material. This additional layer may preferably have a thickness which it is like, for example, the thickness, say, of layer 22*a*, and may be provided to furnish more abrasion and physical damage resistance to that portion of the overall outside coating structure of the invention on hull portion 12 which is exposed to contact with external structures. It should be understood that, as is true with respect to the other drawing figures presented herein, the structural elements pictured in FIG. 3 are not drawn to scale.

If a puncture wound occurs progressing from outside boat hull 11, as, for example, a puncture wound in main-body hull-portion 12, once the water-imbiber beads in the "intermediate" layer in the coating structure becoming exposed to in-rushing water, they react quickly with what has been mentioned above as a water-imbibing, swelling and congealing behavior. This water-imbibing behavior is collaboratively aided by a resulting buildup in compression within the immediately surrounding high-elastomeric material in the intermediate, and the inner and outer, coating-expanse layers, to seal quickly and very effectively against a durable leak. Additionally, importantly aiding this sealing behavior is the presence of water pressure against the outer coating expanse, such as expanse 22, which significantly contributes to elastomeric-material compression of the region wherein the mentioned water-imbibing swelling and congealing activity is occurring.

If such a puncture wound not only penetrates coating expanse 22 and the structure of hull portion 12 but also into at least the intermediate layer included in inside coating expanse 24, then water-imbibing swelling and congealing sealing actions also take place there, aided, in this area, by a buildup of surrounding compression developed in the associated, adjacent high-elastomeric material included within the three layers that collectively form expanse 24.

Sealing action, like that which has just been described with regard to the coating expanses specifically applied to opposite sides of hull portion 12, also take place, as appropriate, with regard to any puncture wound which occurs internally, such as within bulkhead hull portion 14, to deal with any internal, compartment-to-compartment bilge leakage which might be initiated by such an internal wound. Here, also, if there is any water content already within a bilge compartment, and if leakage is occurring from that region where such water is present, that water also aids, through "external" (i.e., leakage-in side) water-pressure application, with internal, anti-leakage, sealing action.

The invention thus proposes a unique anti-water-leak protective coating structure for a water vessel. The proposed coating structure, which may in many situations be fully in contact with water most or all of the time, nonetheless employs seal-enhancing, water-reactive material which remains guardedly shrouded until a puncture wound occurs that exposes it to water, whereupon a material-swelling and congealing action takes place. One, among many, of the interesting features and advantages offered by the invention, as has been explained, is that the pressure of water itself, on the "leakage-in" side of a puncture leak, plays a contributing role in sealing that leak. Thus, in a pair of significant ways, the very water medium against which leakage protection is provided by the invention is centrally enrolled in the intended anti-leak behavior and performance of the invention.

The coating structure of the invention is easily applied where desired, preferably through spraying. Relative layer thicknesses in each coating expanse may be differentiated as desired, and overall coating-expanse thickness is definitively a matter of user choice.

Accordingly, while a preferred embodiment, and certain modifications, of the present invention have been described and illustrated herein, it is appreciated that other variations and modifications may be made without departing from the spirit of the invention.

We claim:

1. An anti-hull-puncture, water-leak-inhibiting, self-sealing, coating structure in combination with a boat hull comprising a boat hull having portions possessing inside and outside surface areas, a body of continuous-phase, non-water-reactive, high-elastomeric-material applied to at least one of said outside and said inside hull surface areas, and embedded within said body, in an initially shrouded and non-exposed condition guarded nominally against any contact with external water, a distribution of individual, spaced, water-reactive, water-imbiber, water-swellable, water-congealable beads each surrounded by the mentioned non-water-reactive, high-elastomeric-material.

2. The combination of claim 1, wherein said body includes (a) spaced, inner and outer layers formed alone of a non-water-reactive, high-elastomeric material, and (b) between said inner and outer layers, an intermediate, high-elastomeric material layer containing said beads.

* * * * *

UNITED STATES PATENT AND TRADEMARK OFFICE

CERTIFICATE OF CORRECTION

PATENT NO. : 8,387,548 B2
APPLICATION NO. : 12/381433
DATED : March 5, 2013
INVENTOR(S) : Thomas S. Ohnstad et al.

It is certified that error appears in the above-identified patent and that said Letters Patent is hereby corrected as shown below:

Title Page, item (73) Assignee: "High Impact Technology, Inc., Tigard, OR (US)" should read --High Impact Technology, LLC, Tigard, OR (US)--

Signed and Sealed this
Second Day of July, 2013

Teresa Stanek Rea
*Acting Director of the United States Patent and Trademark Office*